US010029496B2

(12) United States Patent
Arimizu et al.

(10) Patent No.: US 10,029,496 B2
(45) Date of Patent: Jul. 24, 2018

(54) PRINTING APPARATUS AND HEAD CARTRIDGE

(71) Applicant: CANON KABUSHIKI KAISHA, Tokyo (JP)

(72) Inventors: Hiroshi Arimizu, Kawasaki (JP); Masahiko Kubota, Tokyo (JP); Nobuhito Yamaguchi, Inagi (JP); Yusuke Imahashi, Kawasaki (JP); Arihito Miyakoshi, Tokyo (JP); Yoshinori Itoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/358,710

(22) Filed: Nov. 22, 2016

(65) Prior Publication Data

US 2017/0157959 A1 Jun. 8, 2017

(30) Foreign Application Priority Data

Dec. 8, 2015 (JP) ..... 2015-239623

(51) Int. Cl.
*B41J 25/00* (2006.01)
*B41J 2/01* (2006.01)
(Continued)

(52) U.S. Cl.
CPC ..... *B41J 25/006* (2013.01); *B41J 2/01* (2013.01); *B41J 2/1752* (2013.01);
(Continued)

(58) Field of Classification Search
CPC ..... B41J 2/01; B41J 2/17513; B41J 2/1752; B41J 2/17553; B41J 2/17556; B41J 29/02; B41J 25/006
See application file for complete search history.

(56) References Cited

U.S. PATENT DOCUMENTS 6,997,538 B1 2/2006 Kawamura et al.
9,150,022 B2 10/2015 Miyakoshi et al.
(Continued)

FOREIGN PATENT DOCUMENTS

DE 102012214349 A1 2/2014
JP 07-25007 A 1/1995
(Continued)

OTHER PUBLICATIONS

Search Report and Written Opinion dated Aug. 10, 2017, in Singapore Patent Application No. 10201610254Q.
(Continued)

*Primary Examiner* — Lamson Nguyen
(74) *Attorney, Agent, or Firm* — Fitzpatrick, Cella, Harper & Scinto

(57) ABSTRACT

An object of the present invention is to provide an ink jet printing apparatus that can alleviate an adverse influence by ink mist or airflow turbulence with an inexpensive and small-sized configuration without using power. A printing unit includes a first opening that is parallel to a main scanning direction and is formed at a first surface facing a space defined between an ejection port surface having ejection ports formed thereat and a print medium and a second opening formed at a second surface that is parallel to the main scanning direction and different from the first surface. The first opening and the second opening communicate with each other via a first communication path. The first opening and the second opening are formed in different pressure regions, respectively, in which pressures different from each other are produced when the printing unit is moved in the main scanning direction.

16 Claims, 11 Drawing Sheets

(51) Int. Cl.
*B41J 2/175* (2006.01)
*B41J 29/02* (2006.01)

(52) U.S. Cl.
CPC ..... *B41J 2/17513* (2013.01); *B41J 2/17553* (2013.01); *B41J 2/17556* (2013.01); *B41J 29/02* (2013.01)

(56) References Cited

U.S. PATENT DOCUMENTS

| | | | |
|---|---|---|---|
| 9,469,114 | B2 | 10/2016 | Miyakoshi et al. |
| 2016/0347092 | A1 | 12/2016 | Kurata et al. |

FOREIGN PATENT DOCUMENTS

| | | | |
|---|---|---|---|
| JP | 2000-255083 | A | 9/2000 |
| JP | 2004-330599 | A | 11/2004 |
| JP | 2006-199044 | A | 8/2006 |
| JP | 2014-226832 | A | 12/2014 |

OTHER PUBLICATIONS

Extended European Search Report dated Sep. 13, 2017, in European Patent Application No. 16002508.6.
U.S. Appl. No. 15/266,869, Itaru Wada Arihito Miyakoshi, filed Sep. 15, 2016.
European Office Action dated Jun. 5, 2018, in European Patent Application No. 16002508.6.

PRINTING APPARATUS AND HEAD CARTRIDGE

BACKGROUND OF THE INVENTION

Field of the Invention

The present invention relates to a printing apparatus and a head cartridge in which printing is performed by moving a printing unit provided with ejection ports, through which liquid such as ink is ejected, with respect to a print medium.

DESCRIPTION OF THE RELATED ART

In a printing apparatus in which printing is performed by ejecting liquid such as ink from a liquid ejection head that ejects the ink therefrom, fine ink droplets (i.e., ink mist) may be generated aside from ink droplets landing on a print medium. The ink mist may float inside of the printing apparatus, and then may adhere to the liquid ejection head, thereby causing defective ejection of ink, or may adhere to the inside of the printing apparatus, thereby smearing or degrading each of component parts of the apparatus. In view of the above, Japanese Patent Laid-Open No. 2000-255083 proposes a configuration in which a mist suction hole is formed at a liquid ejection head so as to collect ink mist.

During ink ejection by a liquid ejection head, ink droplets called satellites that land on a print medium also are generated aside from main droplets that are the principal part of ink droplets. The satellites may cause image degradation called ripples due to airflow turbulence occurring between a printing apparatus and a print medium. Moreover, dust on the print medium may float up by airflow turbulence caused by the ejected ink droplets, and then, the dust may adhere to an ejection port surface of a liquid ejection head together with ink mist, thereby inducing ejection deficiency. U.S. Pat. No. 6,997,538 B1 proposes a configuration in which image degradation caused by satellites or ink mist can be prevented.

An apparatus disclosed in Japanese Patent Laid-Open No. 2000-255083 is configured such that ink mist is sucked and collected through holes formed in the vicinity of ejection ports of the liquid ejection head, thus alleviating contamination inside of the apparatus with the ink mist. However, the apparatus needs a special power source such as a pump for sucking the ink mist, thereby inducing an increase in apparatus cost, upsizing of the apparatus, and an increase in power consumption. These are serious problems with printing apparatuses for consumers that require downsizing, low price, and low running cost of the printing apparatus.

In the meantime, Japanese Patent Laid-Open No. 2004-330599 discloses a configuration in which mist is collected without providing any special power source. Specifically, suction holes, through which air is sucked, are formed at front and rear surfaces perpendicular to the movement direction of a liquid ejection head so that mist staying between the liquid ejection head and a print medium is sucked through the suction holes during forward and reverse movements of the liquid ejection head. However, in the apparatus disclosed in Japanese Patent Laid-Open No. 2004-330599, large openings, through which air is sucked, need to be formed at the front and rear surfaces perpendicular to the movement direction of the liquid ejection head, thereby raising problems of upsizing of the liquid ejection head and a large size of the entire apparatus.

Additionally, U.S. Pat. No. 6,997,538 B1 discloses a configuration in which air is blown out of the front portion of the liquid ejection head so as to blow away airflow turbulence occurring between the liquid ejection head and the print medium, to achieve the proper landing position of the ink droplet. However, the configuration disclosed in U.S. Pat. No. 6,997,538 B1 uses a special power source such as a pump for blowing an airflow from the front portion of the liquid ejection head. Therefore, like the technique disclosed in Japanese Patent Laid-Open No. 2000-255083, there arise an increase in apparatus cost and size and an increase in power consumption.

SUMMARY OF THE INVENTION

The present invention has been accomplished to solve the above-described problems. Therefore, an object of the present invention is to provide a printing apparatus capable of reducing an adverse influence by ink mist or airflow turbulence with an inexpensive and small-sized configuration without using any power source.

The present invention is featured by a printing apparatus in which a printing unit provided with ejection ports, through which liquid is ejected, is moved in a main scanning direction along the surface of a print medium so as to perform printing, the printing unit including: a first opening formed at a first surface in the main scanning direction, the first surface facing a region between an ejection port surface having the ejection ports formed thereat and the print medium; a second opening formed at a second surface in the main scanning direction, the second surface being different from the first surface; and a first communication path that allows the first opening and the second opening to communicate with each other, wherein the first opening and the second opening are formed in different pressure regions, in which pressures different from each other are produced in a case where the printing unit is moved in the main scanning direction.

The present invention can reduce an adverse influence such as mist or airflow turbulence so as to alleviate contamination of the liquid ejection head or the inside of the apparatus and degradation of an image, while taking the inexpensive and small-sized configuration without using any additional power source.

Further features of the present invention will become apparent from the following description of exemplary embodiments (with reference to the attached drawings).

DESCRIPTION OF THE EMBODIMENTS

First Embodiment

Figure 1:
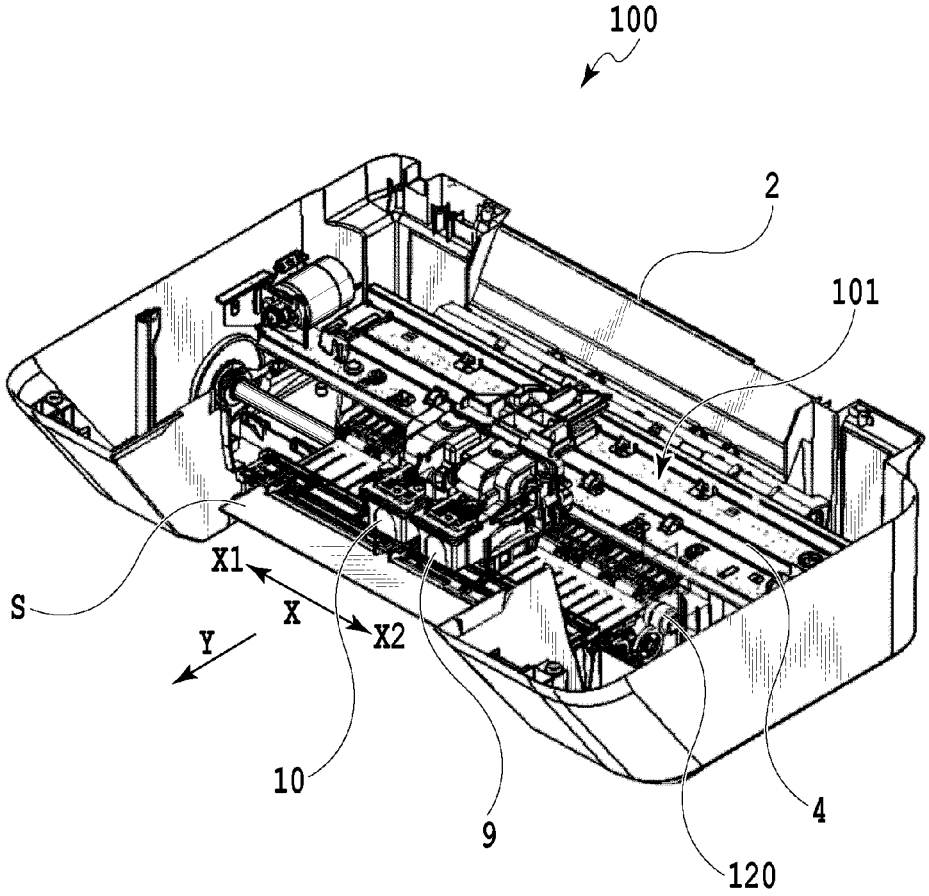
FIG. 1 is a perspective view showing the inside configuration of an ink jet printing apparatus.

A first embodiment of the present invention will be described in detail with reference to the attached drawings. FIG. 1 is a perspective view showing the inside configuration of an ink jet printing apparatus (hereinafter referred to as a printing apparatus) 100 of the present invention. FIG. 1 shows a casing 2 in cross section at a predetermined horizontal position in order to show the configuration of a main body 101 of the printing apparatus housed inside of the casing 2 forming the outline of the printing apparatus 100. In the main body 101, a main chassis 4 forming the framework of the printing apparatus 100 is disposed. The main chassis 4 includes a conveying unit for intermittently conveying a print medium S in a Y direction and a printing unit for performing printing by ejecting ink droplets while moving in a main scanning direction (i.e., an X direction) that is a direction crossing a conveyance direction (i.e., the Y direction) of the print medium S (i.e., a perpendicular direction in FIG. 1).

Figure 2:
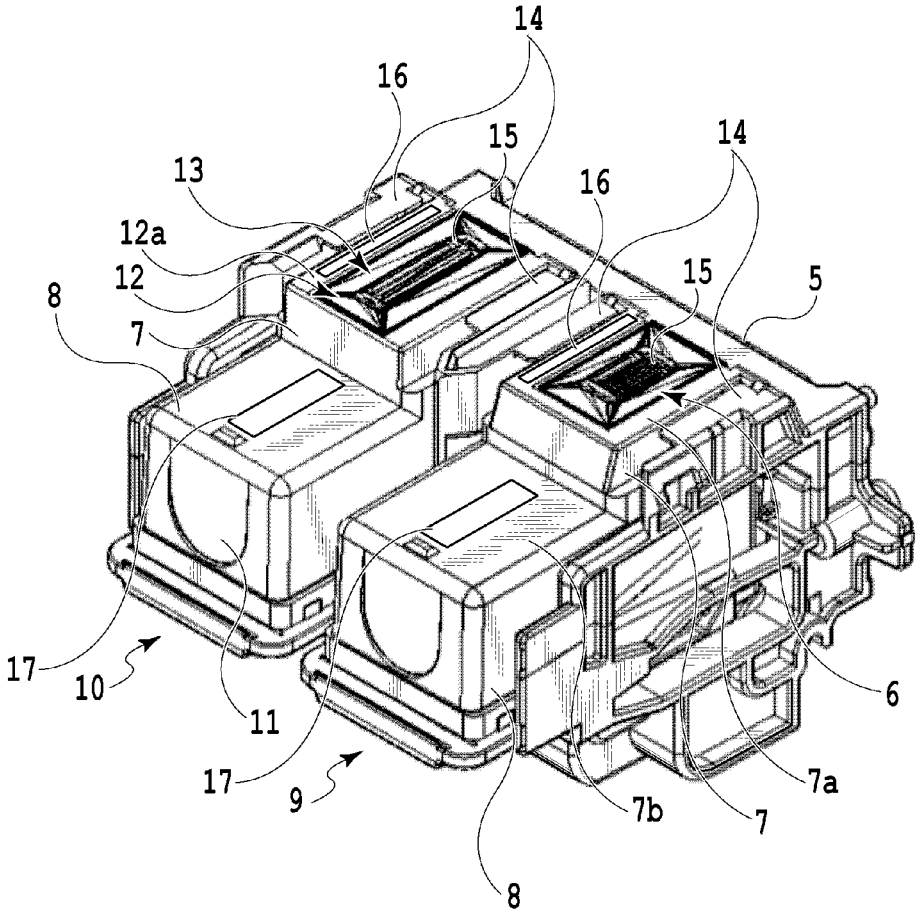
FIG. 2 is a perspective view showing head cartridges and a carriage in a first embodiment, as viewed from the bottom.

The conveying unit is provided with a conveyance roller 120 that is rotated by the drive force of a conveyance motor, not shown, fixed to the main chassis 4, a spur 23 (FIG. 4B), and the like. As shown in FIG. 2, the printing unit is provided with a carriage 5 that is supported by the main chassis 4 in a reciprocating manner in a main scanning direction (i.e., an X direction) and first and second head cartridges 9 and 10 that are mounted on the carriage 5 in a replaceable manner. The carriage 5 moves in an X1 direction (forward) and an X2 direction (reversely) by the drive force of a main scanning motor, not shown.

FIG. 2 is a perspective view showing the carriage 5 forming the printing unit and the first and second head cartridges 9 and 10 mounted on the carriage 5, as viewed from the bottom. The first and second head cartridges 9 and 10 are replaceably supported by mounts 14 formed at the carriage 5. The first head cartridge 9 includes a first liquid ejection head 7, through which ink of each of three colors, that is, yellow (Ye), cyan (C), and magenta (M) is ejected, and an ink tank 8 that contains the ink of each of the colors to be supplied to the liquid ejection head 7. The liquid ejection head 7 includes ejection port arrays 6 (6C, 6M, and 6Ye), each having a plurality of ejection ports, through which the liquid such as ink is ejected, formed for the color inks, respectively (see FIG. 4A and FIGS. 5A to 5E). Hereinafter, the ejection port arrays corresponding to the ink colors, respectively, formed at the liquid ejection head 7 are generically referred to as the first ejection port array 6.

In the meantime, the second head cartridge 10 includes a second liquid ejection head 12 for ejecting a black ink and an ink tank 11 containing the black ink to be supplied to the liquid ejection head 12. A second ejection port array 13 having a plurality of ejections ports, through which the ink is ejected, arrayed thereat is formed at the liquid ejection head 12. The array direction of the ejection ports at each of the second ejection port array 13 and the first ejection port arrays 6 is substantially parallel to the conveyance direction (i.e., the Y direction) of the print medium S. Surfaces having the first and second ejection port arrays 6 and 13 formed thereat (i.e., ejection port surfaces) 15 are positioned flush with respective bottom surfaces (i.e., first surfaces) 7*a* and 12*a* of the first and second liquid ejection heads 7 and 12.

Figure 3A:
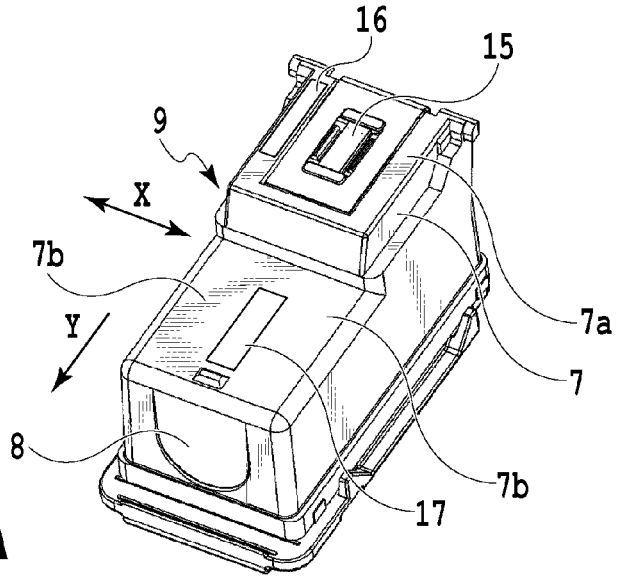
FIGS. 3A to 3C are views showing openings and a communication path at the head cartridge shown in FIG. 2.
Figure 3B:
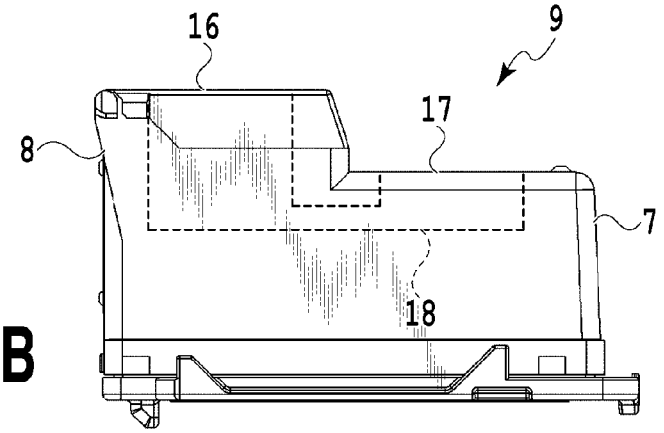
Figure 3C:
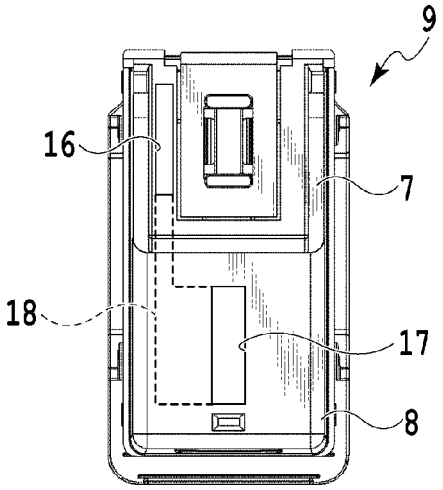

FIGS. 3A to 3C are views showing the first head cartridge 9 shown in FIG. 2, wherein FIG. 3A is a perspective view showing the first head cartridge 9, as viewed on the side of the ejection port surface 15 (i.e., the bottom surface 7*a*); FIG. 3B is a side view showing the first head cartridge 9; and FIG. 3C is a bottom view showing the first head cartridge 9. A first opening 16, through which air is sucked, is formed at the bottom surface (i.e., a first surface) 7*a* of the liquid ejection head 7. The first opening 16 extends in a direction perpendicular to the main scanning direction (i.e., the X direction), that is, in the conveyance direction (i.e., the Y direction) of the print medium S.

Figure 4A:
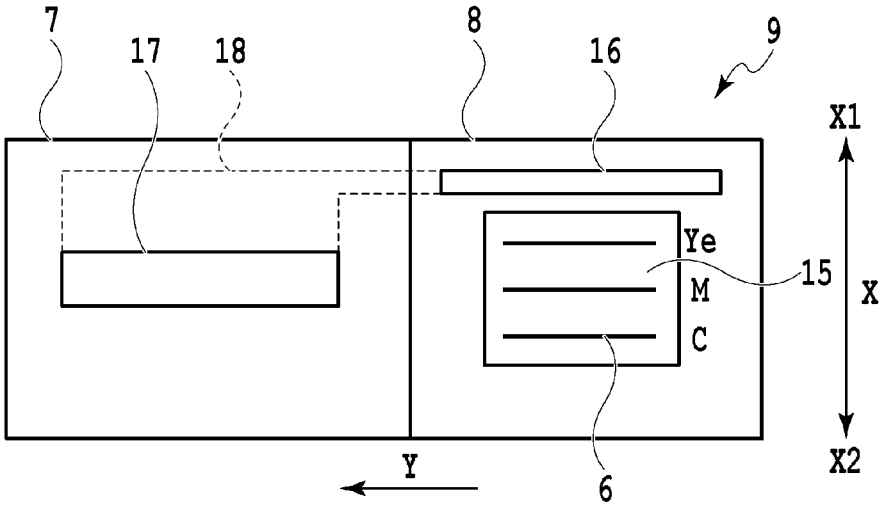
FIGS. 4A and 4B are schematic views showing the head cartridge shown in FIGS. 3A to 3C and its peripheral configuration.
Figure 4B:
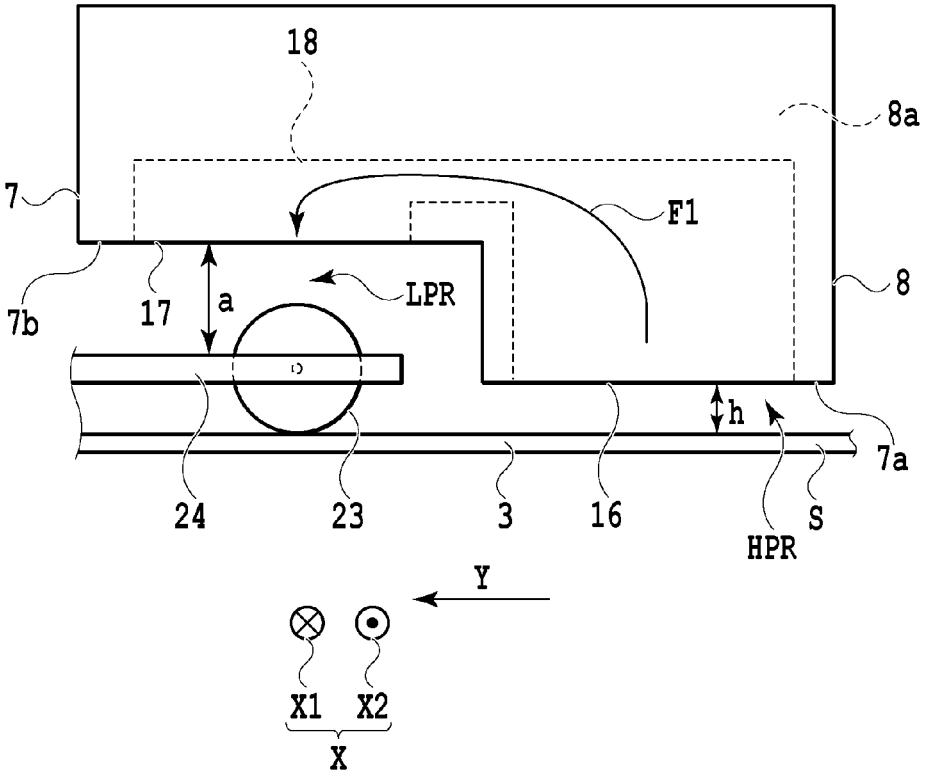

A second opening 17 extending in the conveyance direction (i.e., the Y direction) of the print medium S is formed at a bottom surface (i.e., a second surface) 7*b* of the ink tank 8 in the first head cartridge 9. The second surface 7*b*, at which the second opening 17 is formed, is parallel to the first surface 7*a*, and furthermore, is positioned above the first surface 7*a* in a state in which the ink tank 8 is used. Moreover, the second surface 7*b* is positioned downstream of the first surface 7*a* in the conveyance direction (i.e., the Y direction), and is opposed to an upper surface (i.e., an opposite portion) of a member (i.e., a spur base 24 (see FIG. 4B)) for supporting the spur 23 for conveying the print medium S. Additionally, a first communication path 18 indicated by broken lines in FIGS. 4A and 4B is formed from the first opening 16 to the second opening 17. The first communication path 18 is a space completely separated from an ink containing space 8*a* formed inside of the first head cartridge 9, thereby preventing the intrusion of the ink from the ink containing space 8*a*.

Although the configuration of the first head cartridge 9 has been principally described, the second head cartridge 10 has a configuration substantially similar to that of the first head cartridge 9. Specifically, the second head cartridge 10 is similar to the first head cartridge 9 except that the ink tank 11 contains only the black ink and the ejection port array 13 is adapted to eject only the black ink. As a consequence, the second head cartridge 10 also includes first and second openings 16 and 17 and a first communication path 18, like in the first head cartridge 9.

Here, the formation position of the second opening 17 will be explained by using the first head cartridge (hereinafter simply referred to also as the head cartridge) 9 as an example. In a case where the head cartridge 9 performs main scanning for the purpose of printing, a pressure distribution is generated around the head cartridge 9. Specifically, in a case where the head cartridge 9 reciprocates in the main scanning direction (i.e., the X direction), it pushes away an airflow therearound. Therefore, an airflow is produced at a high speed in a space defined between the casing 2 and the first head cartridge 9. In general, in a case where an airflow passes at a high speed through such a narrow space, an air pressure produced at the region of the space becomes lower than that therearound. This phenomenon is understood based on the Bernoulli theorem.

In the present embodiment, the second opening 17 is formed within a lower air pressure region (i.e., a low pressure region) than that of a region in which the first opening 16 is formed, so that the second opening 17 serves as a power source for sucking air from the first opening 16. In other words, as indicated by an arrow F1 in FIG. 4B, air that stays around the liquid ejection head 7 and contains ink mist is sucked through the first opening 16, and then, is discharged to a low pressure region LPR, in which the second opening 17 is formed. In this manner, it is possible to alleviate the contamination of the ejection port surface 15 or its peripheral portion with the ink mist.

Figures 5A, 5B, 5C:
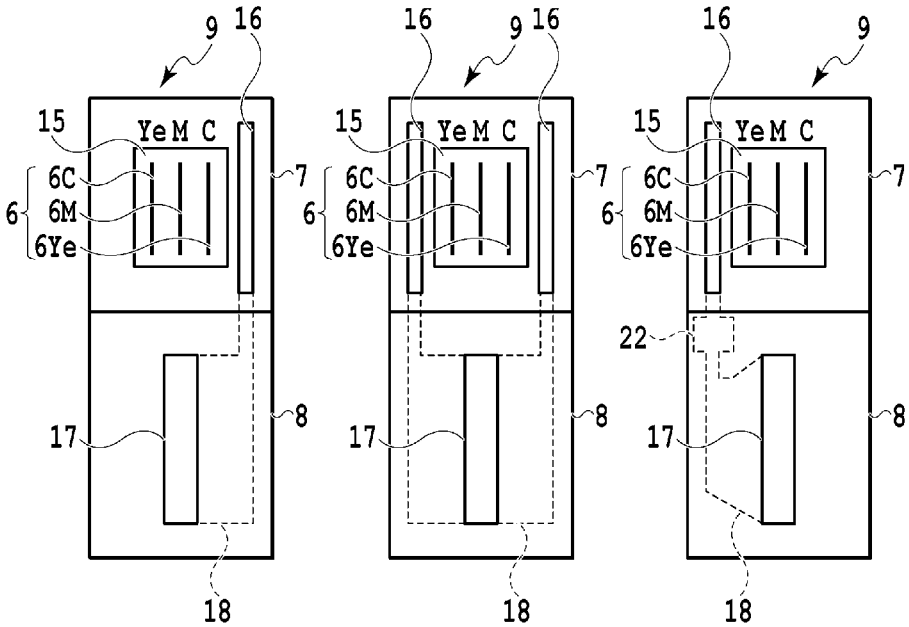
FIGS. 5A to 5E are schematic views showing modifications of the head cartridge in the first embodiment.
Figures 5D, 5E:
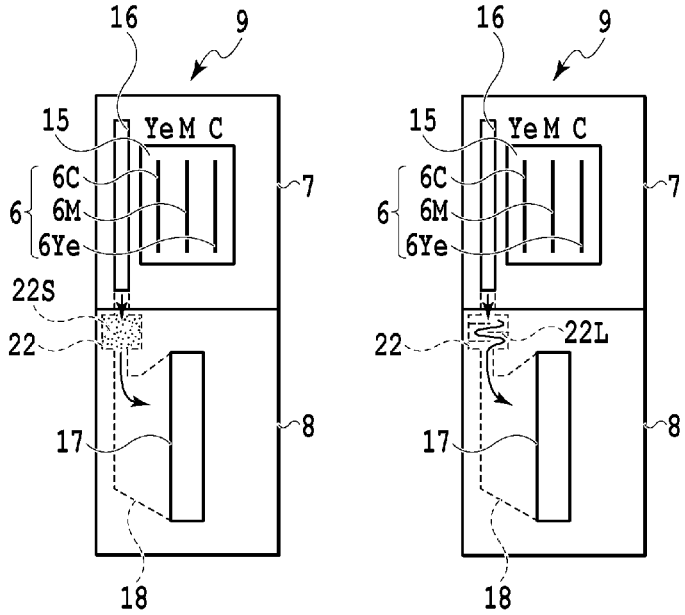

FIGS. 5A to 5E are views showing modifications in the first embodiment. Although the first opening 16 serving as an air suction hole is formed on one side (left in FIG. 3C) of the ejection port surface 15 in FIGS. 2, 3A, 3B, 3C, 4A, and 4B, it may be formed on the other side (right in FIG. 5A) with respect to the ejection port surface 15, as shown in FIG. 5A. Moreover, as shown in FIG. 5B, two openings 16 may be formed in such a manner as to sandwich the ejection port surface 15 therebetween. Additionally, as shown in FIG. 5C, a dust catching mechanism 22 may be disposed on the way of the first communication path 18. Dust (i.e., foreign matter) intruding into the first communication path 18 includes ink mist and dust staying on the print medium S. Examples of the dust catching mechanism 22 are shown in FIGS. 5D and 5E. FIG. 5D shows a configuration in which the dust catching mechanism 22 is filled with a sponge 22S serving as a filter for catching the ink mist. In addition, FIG. 5E shows a configuration in which a plurality of plates 22L for catching the mist are alternately arranged.

Figure 6A:
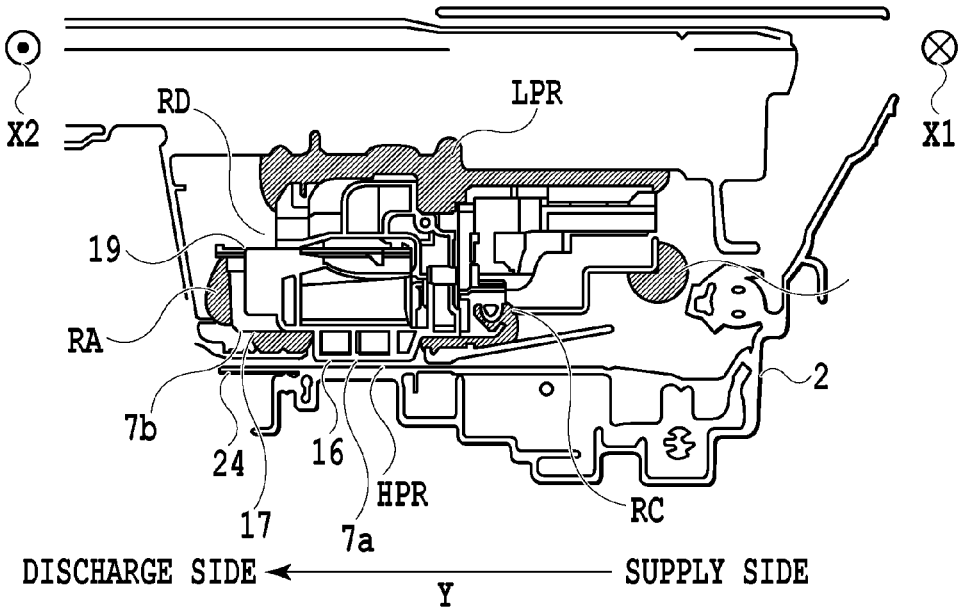
FIGS. 6A and 6B are schematic views showing an atmospheric region and a speed region around the head cartridge.
Figure 6B:
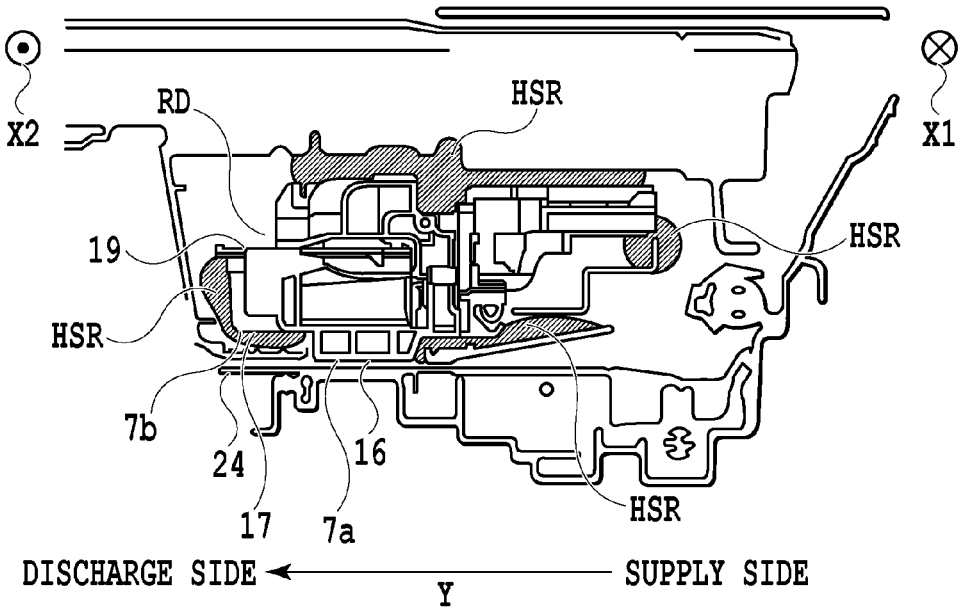

Here, explanation will be made on the pressure distribution in the space region around the liquid ejection head with reference to FIGS. 6A and 6B. FIGS. 6A and 6B are schematic views showing that the pressure distribution generated at the outer surface of the head cartridge 9 is obtained by fluid (i.e., air) simulation in a case where the head cartridge 9 is moved in the main scanning direction (i.e., in a direction perpendicular to a drawing sheet of FIGS. 6A and 6B). FIG. 6A shows a pressure distribution in a vertical cross section obtained by cutting the center of the printing apparatus including the head cartridge 9 in the conveyance direction, wherein a low pressure region is shaded. FIG. 6B shows a distribution of the magnitude of an absolute value of a flow speed (i.e., the sum of three components) in the same cross section as that in FIG. 6A, wherein a high speed region is shaded. An outside line surrounding a head cartridge 9 shows an outline of the cross section of the casing 2 in FIGS. 6A and 6B. Moreover, the left in FIGS. 6A and 6B represents a discharge side of the print medium S whereas the right represents a supply side of the print medium S.

Incidentally, one skilled in the art could have readily carried out simulation of fluid (i.e., air) staying inside of the casing 2 in a case where the head cartridge 9 is moved.

Upon comparison of FIGS. 6A and 6B, it is found that the low pressure region shaded in FIG. 6A (i.e., a second pressure region) LPR substantially corresponds to a high speed region HSR shaded in FIG. 6B. The above-described high speed region HSR is generated since air around the head cartridge 9 is eliminated and the eliminated air passes a space defined between the head cartridge 9 and a portion opposite to the head cartridge 9 in a case where the head cartridge 9 performs main scanning (in a direction perpendicular to a sheet). The portion opposite to the head cartridge 9 may be the spur base 24 facing the second surface 7*b* and the print medium S facing the first surface 7*a* (or a platen for supporting the print medium S). Here, an interval (i.e., a distance from a sheet) h (FIG. 4B) between the first surface 7*a* having the first opening 16 formed thereat and the print medium S is very narrow and has a high flow resistance, and therefore, the air eliminated during the main scanning by the head cartridge 9 can flow only in a small quantity, and furthermore, the flow speed becomes low. As a consequence, the region at the interval h from a sheet becomes a relatively high pressure region (i.e., a first pressure region HPR). In contrast, a space a (FIG. 4B) that is wider than the interval h from a sheet but has a narrower channel cross section than other portions is defined between the second surface 7*b* of the head cartridge 9 and the print medium S or the spur base 24. Consequently, the air eliminated by the head cartridge 9 collectively passes the space a, and therefore, the speed of the passing airflow is increased in comparison with the speed of the airflow passing other portions, particularly, the interval h from a sheet.

In a case where the speed of the airflow passing the space a increases, a pressure (a static pressure) in that region becomes lower than those in other regions based on the Bernoulli theorem. Specifically, the region (the high-speed region) HSR where the speed of the airflow is increased is formed around the head cartridge 9, thus producing the low pressure region (the second pressure region) LPR whose pressure is lower than that at the interval (the distance from a sheet) h between the first surface 7*a* of the liquid ejection head 7 and the print medium S. In contrast, in a case where a space between the head cartridge 9 and a portion facing the head cartridge 9 (e.g., the main body 101 or the casing 2) is large, an increase in speed of the airflow flowing through the space is small, and therefore, an increase in pressure is small as well. Consequently, the pressure in the region (the first pressure region) HPR having the large space between the head cartridge 9 and a portion facing the head cartridge 9 becomes higher than that in the region HSR where the speed of the airflow is remarkably increased. In this manner, the interval of the space between the head cartridge 9 and a portion facing the head cartridge 9 is one of factors that determine the speed distribution of the airflow, that is, the pressure distribution around the head cartridge 9.

In view of the above, in the present embodiment, the second opening 17 is located at a position that satisfies conditions below. Assuming that reference character h designates the interval (the distance from a sheet) between the first surface 7*a* (the ejection port surface 15) of the liquid ejection head 7 and the print medium S (FIG. 4B), and furthermore, reference character a denotes the interval between a surface forming the second opening 17 and a portion facing the surface forming the second opening 17 (FIG. 4B), the second opening 17 is formed at a position that satisfies the following inequality:

$$a>h \quad (1).$$

In a printing apparatus for consumers, the second opening 17 is formed at a position that satisfies the following inequality:

$$a\geq 2h \quad (2).$$

Under this condition, the pressure in the region where the second opening 17 is formed can be sufficiently reduced with respect to the pressure in the region where the first opening 16 is formed. Consequently, the air can be further securely sucked from the first opening 16 to the second opening 17, thus further certainly suppressing the adhesion of the ink mist to the ejection port surface 15.

Using a printing apparatus having a wide format that is commercially available as a product at this point in time, the much preferable range of a is expressed by the following inequality:

$$12h\geq a\geq 2h \quad (3).$$

As described above, the second opening 17 is formed in a region that satisfies the inequalities (1), (2), and (3) according to the model of a printing apparatus (the interval between the liquid ejection head and the main body).

The formation portion of the second opening 17 that satisfies the inequalities (1), (2), and (3) is, for example, a surface (i.e., a sheet discharge side) that is located downstream of the liquid ejection head 7 in the conveyance direction of the print medium S and faces the spur base 24 that supports the spur 23. This surface serves as a favorable low pressure region irrespective of the model of the printing apparatus, and therefore, is suitable for the portion where the second opening 17 is formed.

In addition, as shown in FIG. 6A, a low pressure is produced in a region RA that is a side surface of the liquid ejection head 7 on a sheet discharge side or a region RB that is a side surface of the liquid ejection head 7 on a sheet supply side and a region RC upstream of the liquid ejection head 7, and therefore, the second opening 17 may be formed in the above-described regions. In this case, a channel connecting the first opening 16 and the second opening 17 to each other becomes longer, thereby raising a possibility of a large flow resistance at the channel connecting the first opening 16 and the second opening 17 to each other. As a consequence, the formation position of the second opening 17 needs to be determined in consideration of the balance between the difference in pressure and flow resistance between the openings.

Moreover, a low pressure region caused by the movement of the printing unit is exemplified by a side surface opposed in the movement direction of the printing unit (i.e., a surface perpendicular to the movement direction). In this case, a high pressure is produced at a front surface in the movement direction of the printing unit. In a case where the second opening is formed at the side surface opposed in the movement direction, the pressure at the second opening becomes low, so that the air can be sucked through the first opening, and then, the air can be discharged from the second opening through the channel. However, in a case where the printing unit moves in a reverse direction (i.e., moves reversely), a high pressure is produced since the second opening is positioned at the front surface in the movement direction of the printing unit. Accordingly, the airflow is blown out of the first opening. In a case where the second opening is formed at the surface perpendicular in the movement direction of the printing unit in the above-described manner, the high and low pressures are switched according to the movement direction of the printing unit, that is, the suction and the blowing are switched, thereby reducing the mist recovering efficiency. In contrast, in the present embodiment, as shown in FIG. 6A, the low pressure region is generally determined irrespective of the scanning direction of the printing unit (such as the head cartridges 9 and 10 and the carriage 5). Thus, the mist can be always sucked during the movement of the printing unit, so that the mist can be efficiently collected.

Table 1 shows the effect produced by carrying out the first embodiment. Evaluation items include the level of a smear occurring at the ejection port surface after a printing operation for a long period of time. As shown in Table 1, the frequency (speed) of non-ejection caused by the ink mist staying at the ink ejection surface is reduced.

TABLE 1

| | First Embodiment | Prior Art |
|---|---|---|
| Smear on ejection port surface | The frequency of defective ejection is reduced. | Defective ejection deficiency may occur. |

Incidentally, in a case where the inner surface of the casing 2 is uneven, the high and low pressures are fluctuated according to the unevenness during the scanning of the printing unit, and therefore, it is preferable that a portion of the casing 2 facing the printing unit should be even. The formation of the first and second openings 16 and 17 and the first communication path 18 only at the first head cartridge 9 is more effective than in a case where none of them is formed thereat. The evaluation shown in Table 1 is made in a case where the first and second openings 16 and 17 and the first communication path 18 are formed only at the first head cartridge 9. However, the formation of the first and second openings 16 and 17 and the first communication path 18 at the second head cartridge 10 can produce a more excellent effect.

It is preferable that the specific dimension of the first and second openings should be set: for example, the length of each of the first and second openings is about 10 mm in a planar direction perpendicular to the movement direction of the printing unit in a printer for consumers, and furthermore, the length of the first opening is 1 mm or more in the planar direction along the movement of the printing unit, because the greater it becomes, the more excellent the result becomes. Moreover, it is desirable that the second opening should be securely 3 mm or more.

Second Embodiment

Figure 7A:
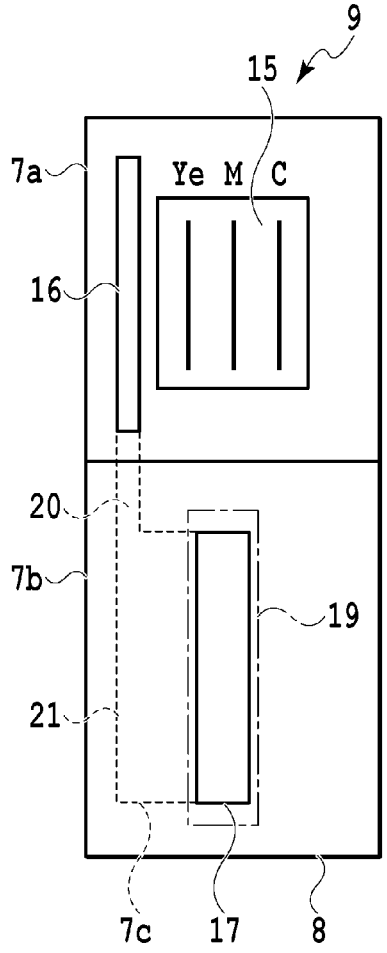
FIGS. 7A and 7B are schematic views showing a second embodiment.
Figure 7B:
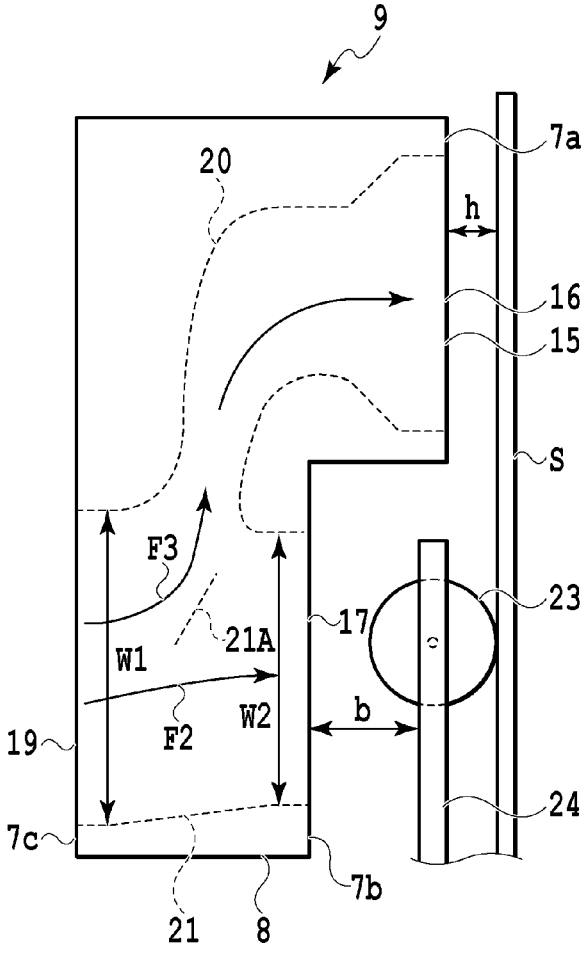

Next, a second embodiment will be explained with reference to FIGS. 7A, 7B, 8A, 8B, 9A, 9B, and 9C. Here, the same or corresponding component parts as or to those in the first embodiment are designated by the same reference numerals, and therefore, their explanation is omitted. FIGS. 7A and 7B are schematic views showing a first head cartridge 9 in the second embodiment, wherein FIG. 7A is a plan view and FIG. 7B is a side view. Also in this second embodiment, like in the first embodiment, a first opening 16 is formed at a first surface (i.e., a bottom surface) 7*a* flush with an ejection port surface 15 at a liquid ejection head 7 of the first head cartridge 9. In addition, a second opening 17 is formed at a second surface (i.e., a bottom surface) 7*b* of an ink tank 8 in the first head cartridge 9. Like in the first embodiment, the second opening 17 is formed at a position where a pressure becomes lower than that at the first opening 16 during scanning by the first head cartridge 9. Moreover, a third opening 19 is formed at the head cartridge 9 at a position facing a third pressure region RD (see FIGS. 6A and 6B) where a pressure becomes higher than that at the first opening 16 during the scanning by the first head cartridge 9. Here, as shown in FIGS. 7A and 7B, the third opening 19 is formed at an upper surface (i.e., a third surface) 7*c* of the head cartridge 9.

Additionally, the third opening 19 and the second opening 17 communicate with each other via a second communication path 21. Moreover, the first opening 16 communicates with the middle position of the second communication path 21 via a first communication path 20. In other words, the first communication path 20 serves as a branch passage branching from the middle position of the second communication path 21. In addition, a separation wall 21A is disposed in the vicinity of the couple portion (i.e., a branch portion) between the first communication path 20 and the second communication path 21.

During a printing operation, pressures at the third opening 19, the second opening 17, and the first opening 16 are higher at the third opening 19, the first opening 16, and the second opening 17 in this order. As a consequence, air flows to the second communication path 21 through the third opening 19, and then, most of the flowing air flows to the second opening 17 whose pressure is lowest. Here, a part of the airflow flowing through the third opening 19 is guided to the first communication path 20 by the separation wall 21A, and is blown toward a print medium S through the first opening 16.

Incidentally, as long as the separation wall 21A can separate a part of the airflow flowing toward the second opening 17 through the third opening 19, its shape is not limited. Specifically, the separation wall 21A is only required to have a surface having an angle with respect to the flow line of the airflow flowing from the third opening 19 to the second opening 17. The angle satisfactorily separates the airflow to the first opening 16. The separation wall 21A may be specifically formed into, for example, a plate-like shape. Alternatively, the separation wall 21A formed into a column, wing, or the like may be used. In a case where it is difficult to form the separation wall 21A, a part of the airflow may be guided toward the first communication path 20 by devising the lateral cross section or channel shape of the second communication path 21. For example, in the second communication path 21, a cross-sectional area W2 on the side of the second opening 17 is more narrowly determined than a cross-sectional area W1 on the side of the third opening 19, thus separating a part of the airflow toward the first communication path 20.

Figure 8A:
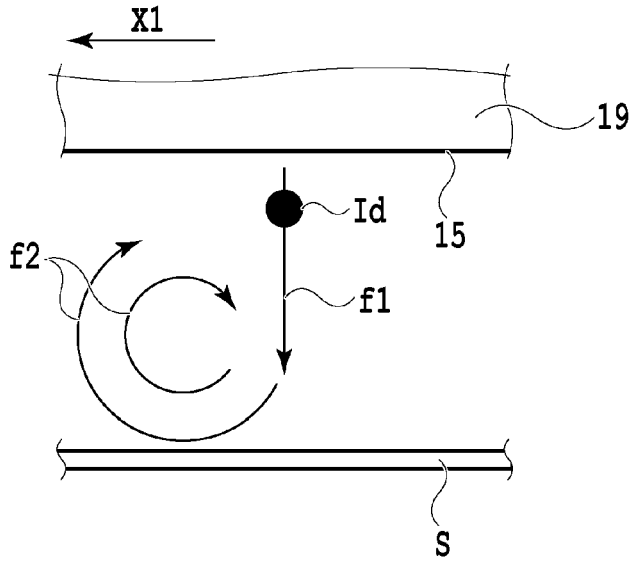
FIGS. 8A and 8B are schematic views showing airflow turbulence on a print medium and air ejected from a second opening.
Figure 8B:
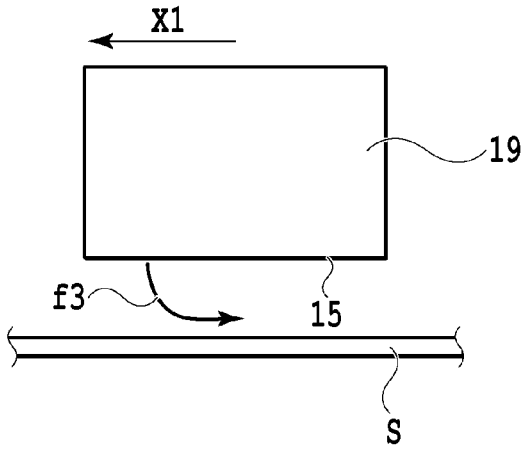

As described above, in the second embodiment, the air is blown between the ejection port surface 15 and the print medium S through the first opening 16, thus improving the quality of an image. Specifically, an eddy turbulence f2, as shown in FIG. 8A, occurs between the ejection port surface 15 and the print medium S due to an airflow f1 produced by ejecting an ink droplet Id through an ejection port in the prior art. Such turbulence deteriorates the landing accuracy of the ink droplet Id so as to degrade an image. However, in the present embodiment, the air f3 is blown out of the ejection port surface 15, as shown in FIG. 8B, and thus, an eddy between the ejection port surface 15 and the print medium S can be eliminated. Consequently, the landing accuracy of the ink droplet is enhanced, so that the quality of an image is improved.

Moreover, in the prior art, dust staying on the print medium S may soar by turbulence occurring between the ejection port surface 15 and the print medium S, to cause it to adhere onto the ejection port surface or the like, thus inducing ink ejection deficiency. In contrast, in the present embodiment, the air injected between the ejection port surface 15 and the print medium S can blow away the turbulence, thus suppressing the rising of the dust staying on the print medium S. Thus, it is possible to alleviate the adhesion of the dust onto the ejection port surface so as to reduce the defective ejection by the head cartridge.

Subsequently, explanation will be specifically made on intervals between the first, second, and third openings 16, 17, and 19 and portions facing thereto, that is, the casing 2 and the print medium S. Reference character h represents an interval (a distance from a sheet) between the first surface 7*a* of the first head cartridge 9 and the print medium S (FIG. 7B). At this time, reference character b represents a distance between the surface where the second opening 17 is formed and the spur base 24 as a part of the casing 2 (i.e., a principal portion except parts such as a rib and a projection) (FIG. 7B). The second opening 17 is formed at a position that satisfies the following inequality:

$$b>h \quad (4).$$

In a printing apparatus for consumers, the second opening 17 is formed at a position that satisfies the following inequality:

$$b\geq 2h \quad (5).$$

Under this condition, the pressure in a region where the second opening 17 is formed can be sufficiently reduced with respect to the pressure in a region where the third opening 19 is formed. Consequently, the airflow can be introduced in a greater quantity from the third opening 19 to the first communication path 20, and accordingly, the air can be introduced in a sufficient quantity to the second communication path 21 as well, so that the air can be securely blown out of the first opening 16. Thus, it is possible to securely eliminate the eddy turbulence occurring between the ejection port surface 15 and the print medium S so as to alleviate the deviation of the landing position of the ink mist or the adhesion of the dust onto the ejection port surface.

By way of a printing apparatus having a wide format that is commercially available as a product at the moment, the much preferable range of b is expressed by the following inequality:

$$12h\geq b\geq 2h \quad (6).$$

As described above, the second opening 17 is formed in a region that satisfies the inequalities (4), (5), and (6) according to the model of a printing apparatus (the interval between the liquid ejection head and the main body).

The formation portion of the second opening 17 that satisfies the inequalities (4), (5), and (6) is, for example, a surface of the liquid ejection head 7 downstream in the conveyance direction of the print medium S (i.e., a sheet discharge side) and facing the spur base 24 that supports the spur 23. This surface is a favorable low pressure region irrespective of the model of the printing apparatus, and therefore, is suitable for the portion where the second opening 17 is formed.

It is preferable that the third opening 19 should be formed in a region whose pressure is higher than that of the first opening 16 within a plane parallel to the movement direction of the first head cartridge 9. The preferable position of the third opening 19 is exemplified by the upper surface of the first head cartridge 9. This is because there is a relatively large space between the upper portion of the first head cartridge 9 and the casing 2. Incidentally, efficiency is greater in a case where a difference in pressure between the first opening 16 and the second opening 17 is smaller. In a case where relationship between the pressure at the first opening 16 and the pressure at the second opening 17 is reversed, as long as the pressure at the third opening 19 is higher than those of the first and second openings 16 and 17, and furthermore, the inside flow speed is moderate, the air can be blown out of the third opening 19.

In terms of the dimensions of the first, second, and third openings, the length of each of the openings in the direction perpendicular to the movement direction of the liquid ejection head in the printing apparatus for consumers is set to 10 mm. As the length of the opening is as great as possible in the movement direction of the liquid ejection head, an excellent result can be produced. In view of this, it is preferable that the length in the movement direction of the first opening should be securely mm or greater, and furthermore, the length in the movement direction of each of the second and third openings should be securely 3 mm or greater. For example, even if the blowing speed is about 0.1 m/s in a case where the length in the movement direction of the first opening is about 3 mm, an effect can be produced such that the soar of dust staying on the print medium S caused by an airflow formed by ejected droplets can be suppressed.

Figures 9A, 9B, 9C:
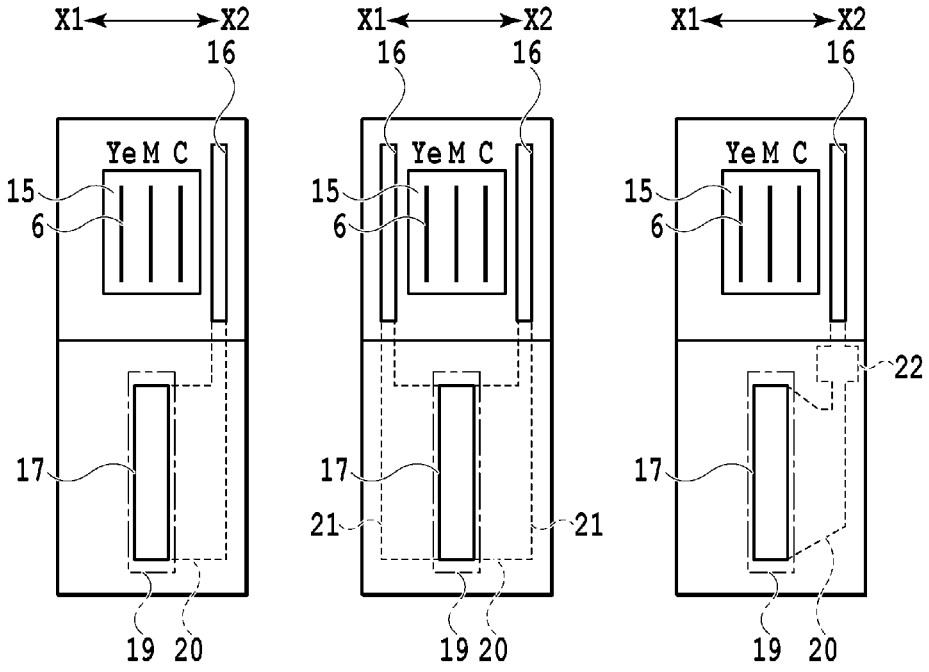
FIGS. 9A to 9C are schematic views showing modifications of the second embodiment.

FIGS. 9A, 9B, and 9C are views showing a modification of the second embodiment. As shown in FIGS. 9A and 9B, the first opening 16 serving as an air blowing-out hole may be formed rearward (rightward in FIG. 9A) of the ejection port array 6 at the ejection port surface 15 in the forward direction of main scanning (i.e., an X1 direction). Moreover, as shown in FIG. 9B, the first openings 16 may be formed rearward in the forward direction and forward in the forward direction (rearward in the reverse direction) with respect to the ejection port array 6. In this manner, in a case where the first openings 16 serving as air blowing-out holes are formed on both sides of the ejection port array 6, an image of a good quality having few landing deviations of an ink droplet can be formed both forward and reversely.

Additionally, as shown in FIG. 9C, a dust catching mechanism 22 may be provided on the first communication path 20, for catching ink mist or dust. The dust catching mechanism 22 enables clean air without any ink mist or dust flowing through the third opening 19 to be blown out of a blowing-out hole.

Table 2 shows the evaluation results of effects produced in the second embodiment according to the level of the disturbance of a printed image. As shown in Table 2, the frequency of image disturbance caused by the deviation of the ink landing position can be reduced and the level of image disturbance is reduced as well in the second embodiment in comparison with an image formed by a printing apparatus in the prior art.

TABLE 2

| | Second Embodiment | Prior Art |
|---|---|---|
| Image disturbance | The frequency and level of image disturbance caused by deviation of landing position of ink droplet is reduced. | Image disturbance caused by deviation of landing position of ink droplet may be marked. |

Table 3 shows the comparison results of the amount of dust adhering onto the ejection surface in the second embodiment in comparison with the prior art. As shown in Table 3, the frequency of ejection deficiency caused by the adhesion of dust onto the ejection port surface is remarkably reduced in the second embodiment in comparison with the prior art.

TABLE 3

| | Second Embodiment | Prior Art |
|---|---|---|
| Non-ejection caused by dust adhering to ejection port surface | The frequency of non-ejection is reduced. | The frequency of non-ejection is high. |

Other Embodiments

The first embodiment has been described by way of the case where the second opening 17 is formed on a flat bottom (i.e., the second surface) in the first and second head cartridges 9 and 10. However, the bottom (i.e., the second surface) at which the second opening is formed may be curved.

Figure 10A:
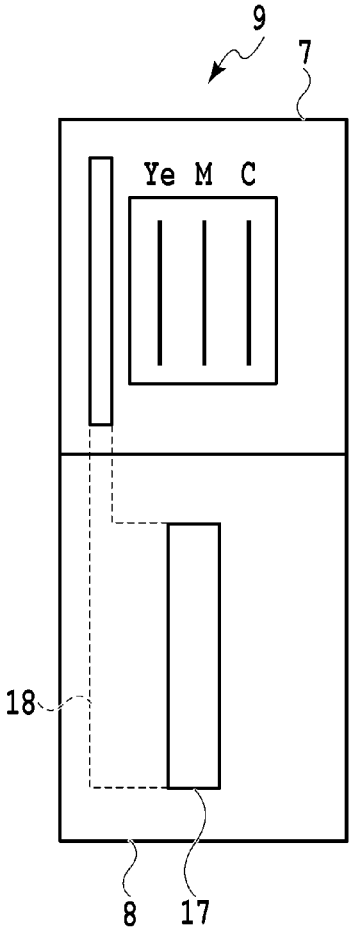
FIGS. 10A to 10C are schematic views showing a head cartridge in another embodiment.
Figure 10B:
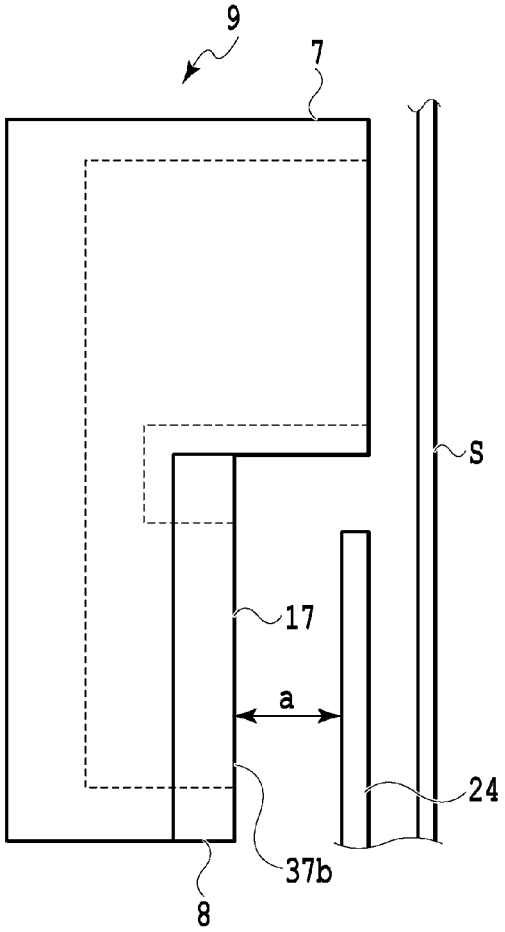
Figure 10C:
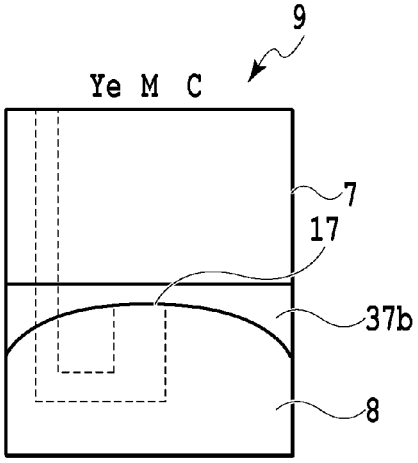

FIGS. 10A to 10C are views schematically showing the formation surface of the second opening in the first and second embodiments, wherein FIG. 10A is a bottom view, FIG. 10B is a side view, and FIG. 10C is a front view. As shown in FIGS. 10A to 10C, a distance a (or b) between a second opening 17 and a spur base 24 at a formation surface (i.e., a second surface) 37*b* of the second opening 17 is shortest near the second opening 17, and becomes longer as it goes away in a main scanning direction. The formation surface 37*b* of the second opening 17 includes a smooth surface having an arcuate projection projecting toward the spur base 24 at the middle position in the main scanning direction. In this manner, the formation surface 37*b* of the second opening 17 is formed into a curve such that the distance a (or b) gradually becomes greater toward the front and back ends from the center in the main scanning direction. Consequently, an airflow can be introduced in a greater quantity between the second opening 17 and the spur base 24 during main scanning. As the distance between the formation surface 37*b* of the second opening 17 and the spur base 24 gradually becomes shorter, the speed of the airflow becomes higher, resulting in the low pressure at a second release portion based on the Bernoulli theorem. In this manner, the formation surface 37*b* of the second opening 17 is formed into a curve, so that a great quantity of air can pass at a high speed, thus efficiently producing a low pressure.

Figure 11A:
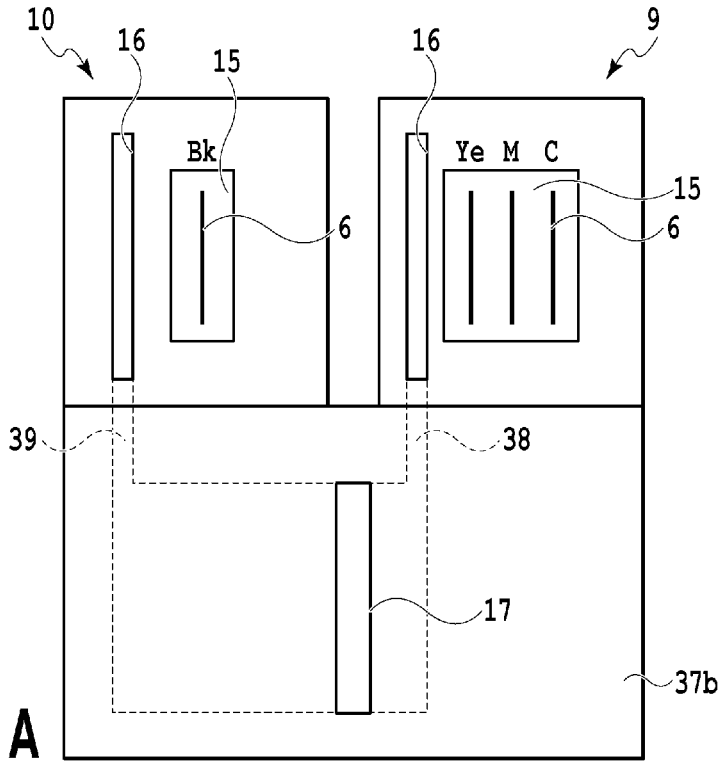
FIGS. 11A and 11B are schematic views showing modifications in a further embodiment.
Figure 11B:
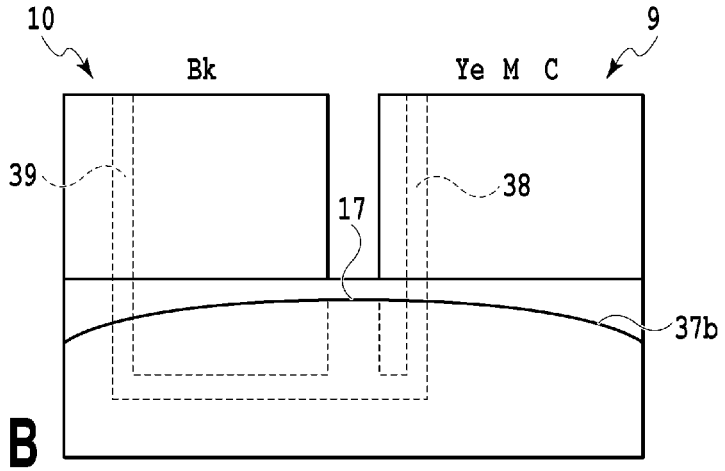

Although the example in which the bottom (i.e., the second surface) of a first head cartridge 9 is formed into a curve has been shown with reference to FIGS. 10A to 10C, the bottom (i.e., a second surface) of a second head cartridge 10 may be formed into a curve in the same manner. In addition, as shown in FIGS. 11A and 11B, a single curve surface may form bottoms (i.e., second surfaces) 37*b* of ink tanks in the first head cartridge 9 and the second head cartridge 10, and a second opening 17 is formed at the curve surface. In this case, the second opening 17 communicates with first openings 16 formed at the first and second head cartridges 9 and 10 via channels 38 and 39, respectively, whereby sucking air is sucked through the first opening 16 at each of the head cartridges by the effect of a low pressure produced at the second opening 17.

Alternatively, in the configuration shown in FIGS. 11A and 11B, a third opening may be formed at the upper surfaces (lower surfaces in FIG. 11B (i.e., a third surface)) of the first and second head cartridges 9 and 10, and then, a channel communicating with the third opening may be coupled to a channel that allows the first opening 16 and the second opening 17 to communicate with each other. In this manner, air introduced through the third opening can be ejected through the first opening formed at each of the head cartridges, like in the second embodiment. Thus, it is possible to reduce the adhesion of dust or the like onto an ejection port surface and the deviation of an ink landing position.

Alternatively, in the configuration shown in FIGS. 11A and 11B, a third opening may be formed at the upper surfaces (lower surfaces in FIG. 11B (i.e., a third surface)) of the first and second head cartridges 9 and 10, and then, a channel communicating with the third opening may be coupled to a channel that allows the first opening 16 and the second opening 17 to communicate with each other. In this manner, air introduced through the third opening can be ejected through the first opening formed at each of the ink cartridges, like in the second embodiment. Thus, it is possible to reduce the adhesion of dust or the like onto an ejection port surface and the deviation of an ink landing position.

The first and second openings and channels according to the present invention may be formed at the carriage 5 that is a part of the printing unit.

Incidentally, the present invention may be applied to not only the printing apparatus for consumers but also a large-sized, page-wide printing apparatus. Moreover, the present invention may be applied to a printing apparatus in which ink is supplied from a main body via a tube.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-239623, filed Dec. 8, 2015, which is hereby incorporated by reference herein in its entirety.

What is claimed is:

1. A printing apparatus in which a printing unit provided with ejection ports, through which liquid is ejected, is moved in a main scanning direction along the surface of a print medium so as to perform printing, the printing unit comprising:

a first opening formed at a first surface, the first surface facing a region between an ejection port surface having the ejection ports formed thereat and the print medium;

a second opening formed at a second surface, the second surface being different from the first surface; and a first communication path that allows the first opening and the second opening to communicate with each other, wherein the first opening and the second opening are formed in different pressure regions, in which pressures different from each other are produced in a case where the printing unit is moved in the main scanning direction, a second pressure region in which the second opening is formed is a region whose pressure is lower than that in a first pressure region in which the first opening is formed in a case where the printing unit is moved in the main scanning direction, the printing unit is moved inside of a casing of the printing apparatus, the first pressure region is formed between the first surface and the print medium, and the second pressure region is formed between the second surface and a part of the casing facing the second surface.

2. The printing apparatus according to claim 1, wherein the following inequality is satisfied:

$$a>h,$$

where h represents an interval between the first opening and the print medium and a represents an interval between the second opening and the part of the casing.

3. The printing apparatus according to claim 1, wherein the following inequality is satisfied:

$$a\geq 2h,$$

where h represents an interval between the first opening and the print medium and a represents an interval between the second opening and the part of the casing.

4. The printing apparatus according to claim 1, wherein the following inequality is satisfied:

$$12h\geq a\geq 2h,$$

where h represents an interval between the first opening and the print medium and a represents an interval between the second opening and the part of the casing.

5. The printing apparatus according to claim 1, wherein the print medium is conveyed in a conveyance direction that is transverse to the main scanning direction, and the second opening is positioned downstream in the conveyance direction.

6. The printing apparatus according to claim 1, further comprising a catching unit that catches foreign matter flowing in the first communication path.

7. The printing apparatus according to claim 1, wherein the printing unit further comprises:

a third opening formed at a third surface in a third pressure region whose pressure is higher than those in the first and second pressure regions in a case where the printing unit is moved in the main scanning direction; and a second communication path that allows the third opening and the first communication path to communicate with each other.

8. The printing apparatus according to claim 7, wherein the third pressure region is formed between the third surface and the casing, the third surface being located at a position different from the first surface.

9. The printing apparatus according to claim 8, wherein the following inequality is satisfied:

$$b>h,$$

where b represents an interval between the second opening and the part of the casing and h represents an interval between the first opening and the print medium.

10. The printing apparatus according to claim 8, wherein the following inequality is satisfied:

$$b\geq 2h,$$

where b represents an interval between the second opening and the part of the casing and h represents an interval between the first opening and the print medium.

11. The printing apparatus according to claim 8, wherein the following inequality is satisfied:

$$12h\geq b\geq 2h,$$

where b represents an interval between the second opening and the part of the casing and h represents an interval between the first opening and the print medium.

12. The printing apparatus according to claim 1, wherein the second surface is formed into an arcuate projection projecting toward the part of the casing, the second opening being formed at a position at which a distance from the part is shortest within the arcuate projection.

13. A head cartridge to be mounted on a printing apparatus that is provided with ejection ports, through which liquid is ejected, and is moved in a main scanning direction along the surface of a print medium so as to perform printing, the head cartridge comprising:

a first opening formed at a first surface, the first surface facing a region between an ejection port surface having the ejection ports formed thereat and the print medium;

a second opening formed at a second surface, the second surface being different from the first surface; and a first communication path that allows the first opening and the second opening to communicate with each other, wherein the first opening and the second opening are formed in different pressure regions, in which pressures different from each other are produced in a case where the head cartridge is moved in the main scanning direction, a second pressure region in which the second opening is formed is a region whose pressure is lower than that in a first pressure region in which the first opening is formed in a case where the head cartridge is moved in the main scanning direction, the first pressure region is formed between the first surface and the print medium, and the second pressure region is formed between the second surface and a part of the printing apparatus facing the second surface.

14. The head cartridge according to claim 13, wherein the following inequality is satisfied:

$$a>h,$$

where h represents an interval between the first opening and the print medium and a represents an interval between the second opening and the part of the printing apparatus.

15. A printing apparatus in which a printing unit provided with ejection ports, through which liquid is ejected, is moved in a main scanning direction along the surface of a print medium so as to perform printing, the printing unit comprising:

a first opening formed at a first surface, the first surface being a first bottom surface of the printing unit, flush with an ejection port surface having the ejection ports formed thereat, and facing the print medium;

a second opening formed at a second surface, the second surface being a second bottom surface of the printing unit different from the first bottom surface; and a communication path that allows the first opening and the second opening to communicate with each other, wherein the first opening and the second opening are formed in different pressure regions, in which pressures different from each other are produced in a case where the printing unit is moved in the main scanning direction, the print medium is conveyed in a conveyance direction that is transverse to the main scanning direction, and the second opening is positioned downstream in the conveyance direction.

16. A printing apparatus in which a printing unit provided with ejection ports, through which liquid is ejected, is moved in a main scanning direction along the surface of a print medium so as to perform printing, the printing unit comprising:

a first opening formed at a first surface, the first surface being a first bottom surface of the printing unit, flush with an ejection port surface having the ejection ports formed thereat, and facing the print medium;

a second opening formed at a second surface, the second surface being a second bottom surface of the printing unit different from the first bottom surface;

a communication path that allows the first opening and the second opening to communicate with each other; and a catching unit that catches foreign matter flowing in the communication path, wherein the first opening and the second opening are formed in different pressure regions, in which pressures different from each other are produced in a case where the printing unit is moved in the main scanning direction.

* * * * *